US008368595B2

(12) United States Patent
Lee et al.

(10) Patent No.: US 8,368,595 B2
(45) Date of Patent: Feb. 5, 2013

(54) METAMATERIAL LOADED ANTENNA DEVICES

(75) Inventors: Cheng-Jung Lee, San Diego, CA (US); Ajay Gummalla, San Diego, CA (US); Maha Achour, Encinitas, CA (US)

(73) Assignee: Tyco Electronics Services GmbH (CH)

( * ) Notice: Subject to any disclaimer, the term of this patent is extended or adjusted under 35 U.S.C. 154(b) by 611 days.

(21) Appl. No.: 12/563,035

(22) Filed: Sep. 18, 2009

(65) Prior Publication Data

US 2010/0073254 A1 Mar. 25, 2010

Related U.S. Application Data

(60) Provisional application No. 61/098,735, filed on Sep. 19, 2008.

(51) Int. Cl.
*H01Q 1/38* (2006.01)

(52) U.S. Cl. ..... 343/700 MS; 343/909

(58) Field of Classification Search ..... 343/700 MS, 343/749, 846, 909

See application file for complete search history.

(56) References Cited

U.S. PATENT DOCUMENTS

| | | | | |
|---|---|---|---|---|
| 7,592,957 | B2 | 9/2009 | Achour et al. | |
| 7,764,232 | B2 * | 7/2010 | Achour et al. | 343/700 MS |
| 7,855,696 | B2 * | 12/2010 | Gummalla et al. | 343/876 |
| 2008/0048917 | A1 | 2/2008 | Achour et al. | |
| 2008/0258981 | A1 | 10/2008 | Achour et al. | |

FOREIGN PATENT DOCUMENTS

| | | | |
|---|---|---|---|
| WO | 2007127955 | | 11/2007 |
| WO | WO-2007127955 | A3 | 11/2007 |
| WO | WO-2010033865 | A2 | 3/2010 |

OTHER PUBLICATIONS

Caloz and Itoh, Electromagnetic Metamaterials: Transmission Line Theory and Microwave Applications, John Wiley & Sons (2006).

Itoh, T., "Invited Paper: Prospects for Metamaterials," Electronics Letters, 40(16):972-973, Aug. 2004.

U.S. Appl. No. 61/098,735, filed Sep. 19, 2008, entitled "Metamaterial Loaded Antenna Structures" by Lee et al.

International Search Report and Written Opinion dated Apr. 28, 2010 for International Patent Application No. PCT/US2009/057577 filed Sep. 18, 2009 (11 pages).

Quevedo-Teruel, O., et al. "Compact Multi-Frequency PIFA Antenna Based on Backward Modes," The 2nd European Conference on Antennas and Propagation (EuCAP 2007), Nov. 11-16, 2007, Edinburgh, UK. Pages 1-5.

Wu, Chien-Hung; et al. "A novel small planar antenna utilizing cascaded right/left-handed transmission lines," IEEE Antennas and Propagation Society INternational Symposium 2007, Jun. 9-15, 2007, Honolulu, HI USA. Pages 1889-1892.

"International Application Serial No. PCT/US2009?057577, International Search Report mailed Apr. 28, 2010", 3 pgs.

Quevedo-Teruel, O., et al., "Compact Multi-Frequency PIFA Antenna Based on Backward Modes", 2nd European Conference on Antennas and Propagation (EuCAP 2007), (2007), 5 pgs.

Wu, Chien-Hung, et al., "A novel small planar antenna utilizing cascaded right/left-handed transmission lines", 2007 IEEE Antennas and Propagation Society International Symposium, (2007), 1889-1892.

* cited by examiner

*Primary Examiner* — Michael C Wimer

(74) *Attorney, Agent, or Firm* — Schwegman Lundberg Woessner P.A.

(57) ABSTRACT

Techniques and devices based on antenna structures with a MTM loading element.

21 Claims, 19 Drawing Sheets

METAMATERIAL LOADED ANTENNA DEVICES

PRIORITY CLAIM AND RELATED APPLICATION

This patent document claims the benefit of the U.S. Provisional Patent Application Ser. No. 61/098,735 entitled "Metamaterial Loaded Antenna Systems," filed on Sep. 19, 2008, which is incorporated herein by reference.

BACKGROUND

This document relates to antenna devices with metamaterial loading elements.

The propagation of electromagnetic waves in most materials obeys the right-hand rule for the (E,H,β) vector fields, where E is the electrical field, H is the magnetic field, and β is the wave vector (or propagation constant). The phase velocity direction is the same as the direction of the signal energy propagation (group velocity) and the refractive index is a positive number. Such materials are "right handed (RH)" materials. Most natural materials are RH materials. Artificial materials can also be RH materials.

A metamaterial (MTM) has an artificial structure. When designed with a structural average unit cell size ρ much smaller than the wavelength of the electromagnetic energy guided by the metamaterial, the metamaterial can behave like a homogeneous medium to the guided electromagnetic energy. Unlike RH materials, a metamaterial can exhibit a negative refractive index, and the phase velocity direction is opposite to the direction of the signal energy propagation where the relative directions of the (E,H,β) vector fields follow the left-hand rule. Metamaterials that support only a negative index of refraction with permittivity ∈ and permeability μ being simultaneously negative are pure "left handed (LH)" metamaterials.

Many metamaterials are mixtures of LH metamaterials and RH materials and thus are Composite Right and Left Handed (CRLH) metamaterials. A CRLH metamaterial can behave like a LH metamaterial at low frequencies and a RH material at high frequencies. Implementations and properties of various CRLH metamaterials are described in, for example, Caloz and Itoh, "Electromagnetic Metamaterials: Transmission Line Theory and Microwave Applications," John Wiley & Sons (2006). CRLH metamaterials and their applications in antennas are described by Tatsuo Itoh in "Invited paper: Prospects for Metamaterials," Electronics Letters, Vol. 40, No. 16 (August, 2004). CRLH metamaterials can be structured and engineered to exhibit electromagnetic properties that are tailored for specific applications and can be used in applications where it may be difficult, impractical or infeasible to use other materials. In addition, CRLH metamaterials may be used to develop new applications and to construct new devices that may not be possible with RH materials.

SUMMARY

This document provides techniques and devices based on antennas structures with a MTM loading element.

In one aspect, an antenna device is provided to include a substrate; a ground electrode formed on the substrate; a feed line formed on the substrate; and a loading element coupling the feed line to the ground electrode. The feed line directs an antenna signal to or from the loading element, and the feed line and the loading element are structured to form a composite right and left handed (CRLH) metamaterial structure that supports a plurality of frequency resonances associated with the antenna signal.

In another aspect, an antenna device is provided to include a first substrate having a first surface; a second substrate placed in parallel to the first substrate and having a second surface; a ground electrode formed on the second surface; a feed line formed vertical to the first surface and the second surface, having a first end on the first surface and a second end on the second surface; and a loading element having a first portion formed on the first surface and a second portion formed vertical to the first surface and the second surface, the first portion coupled to the first end of the feed line and the second portion coupled to the ground electrode on the second surface. The feed line directs an antenna signal to or from the loading element, and the feed line and the loading element are structured to form a composite right and left handed (CRLH) metamaterial structure that supports a plurality of frequency resonances associated with the antenna signal.

In yet another aspect, an antenna device is provided to include a dielectric structure made of one or more electrically insulating materials; one or more ground electrodes formed on the dielectric structure as an electrical ground; a metamaterial (MTM) loading element formed on the dielectric structure to form part of a radiating structure of the antenna device that receives an antenna signal or radiates an antenna signal; and a feed line formed on the dielectric structure and made of an electrical conductor. The feed line is coupled to the MTM loading element to direct the antenna signal to the MTM loading element or to receive the antenna signal from the MTM loading element. This antenna device includes a via conductor formed on the dielectric structure having one end in direct contact with the MTM loading element and another end in direct contact with the one or more ground electrodes; and a shorting stub formed of an electrical conductor and in direct contact with the MTM loading element at a location different from a contact location between the MTM loading element and the via conductor. The shorting stub is in direct contact with the one or more ground electrodes and is structured and positioned to facilitate impedance matching of the antenna device. The dielectric structure, the one or more ground electrodes, the MTM loading element, the feed line and the via conductor are structured to collectively form a composite right and left handed (CRLH) metamaterial structure that supports two or more frequency resonances associated with the antenna signal.

These and other implementations and their variations are described in detail in the attached drawings, the detailed description and the claims.

DETAILED DESCRIPTION

Figure 1A:
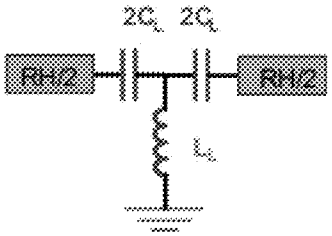
FIGS. 1A-1E show examples of CRLH unit cells.
Figure 1B:
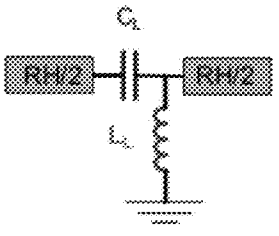
Figure 1C:
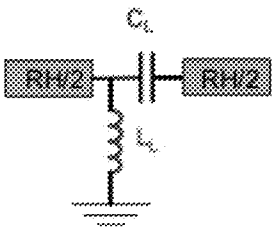
Figure 1D:
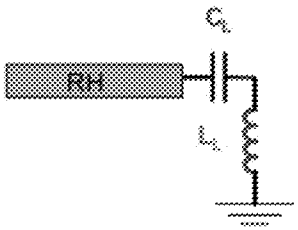
Figure 1E:
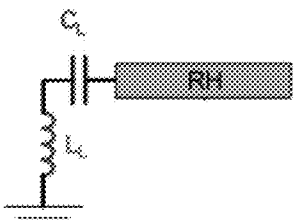
Figure 1F:
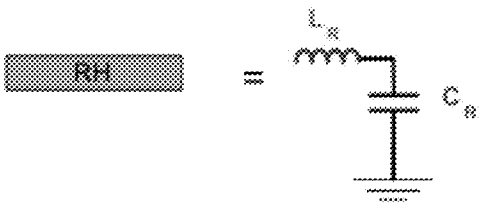
FIG. 1F shows an example of an RH transmission line expressed in terms of equivalent circuit parameters.

Metamaterial (MTM) structures can be used to construct antennas, transmission lines and other RF components and devices, allowing for a wide range of technology advancements such as functionality enhancements, size reduction and performance improvements. These MTM-based components and devices can be designed by using CRLH unit cells. FIGS. 1A-1E show examples of the CRLH unit cells, where $L_R$ is a RH series inductance, $C_L$ is a LH series capacitance, $L_L$ is a LH shunt inductance, and $C_R$ is a RH shunt capacitance. These elements represent equivalent circuit parameters for a CRLH unit cell. The block indicated with "RH" in these figures represents a RH transmission line, which can be equivalently expressed with the RH shunt capacitance $C_R$ and the RH series inductance $L_R$, as shown in FIG. 1F. "RH/2" in these figures refers to the length of the RH transmission line being divided by 2. Exemplary variations of the CRLH unit cell include a configuration as shown in FIG. 1A but with RH/2 and CL interchanged; and configurations as shown in FIGS. 1A-1C but with RH/4 on one side and 3RH/4 on the other side instead of RH/2 on both sides. Alternatively, any complementary fractions can be used to divide the RH transmission line. The MTM structures can be implemented based on these CRLH unit cells by using distributed circuit elements, lumped circuit elements or a combination of both. Such MTM structures can be fabricated on various circuit platforms, including circuit boards such as a FR-4 Printed Circuit Board (PCB) or a Flexible Printed Circuit (FPC) board. Examples of other fabrication techniques include thin film fabrication techniques, system on chip (SOC) techniques, low temperature co-fired ceramic (LTCC) techniques, and monolithic microwave integrated circuit (MMIC) techniques.

A pure LH metamaterial follows the left-hand rule for the vector trio (E,H,β), and the phase velocity direction is opposite to the signal energy propagation direction. Both the permittivity ϵ and permeability μ of the LH material are simultaneously negative. A CRLH metamaterial can exhibit both left-handed and right-handed electromagnetic properties depending on the regime or frequency of operation. The CRLH metamaterial can exhibit a non-zero group velocity when the wavevector (or propagation constant) of a signal is zero. In an unbalanced case, there is a bandgap in which electromagnetic wave propagation is forbidden. In a balanced case, the dispersion curve does not show any discontinuity at the transition point of the propagation constant $\beta(\omega_0)=0$ between the left- and right-handed regions, where the guided wavelength is infinite, i.e., $\lambda_g=2\pi/|\beta|\rightarrow\infty$, while the group velocity is positive:

$$v_g = \left.\frac{d\omega}{d\beta}\right|_{\beta=0} > 0. \qquad \text{Eq. (1)}$$

This state corresponds to the zeroth order mode m=0 in a transmission line (TL) implementation. The CRLH structure supports a fine spectrum of resonant frequencies with the dispersion relation that extends to the negative β region.

Figure 2:
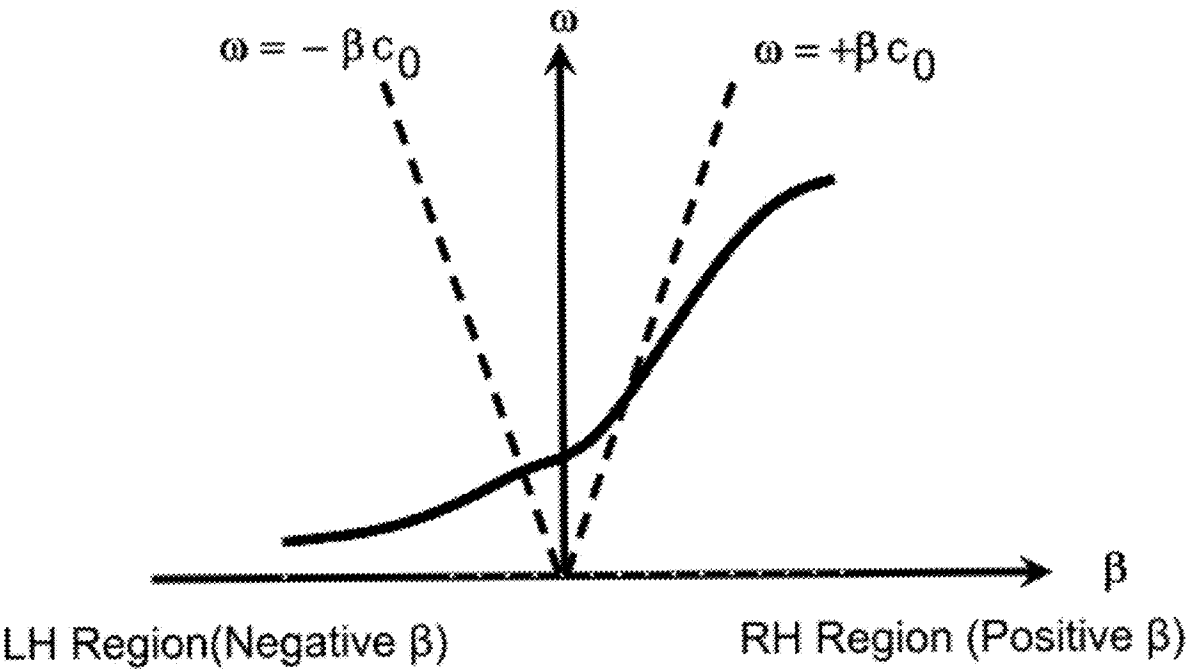
FIG. 2 shows the dispersion curve of an exemplary balanced CRLH unit cell.

FIG. 2 shows the dispersion curve for the case of a balanced CRLH unit cell. In the unbalanced case, there are two possible zero$^{th}$ order resonances, $\omega_{se}$ and $\omega_{sh}$, which can support an infinite wavelength (β=0, fundamental mode) and are expressed as:

$$\omega_{sh} = \frac{1}{\sqrt{C_R L_L}} \text{ and } \omega_{se} = \frac{1}{\sqrt{C_L L_R}}, \qquad \text{Eq. (2)}$$

where $C_R L_L \neq C_L L_R$. At $\omega_{se}$ and $\omega_{sh}$, both group velocity ($v_g=d\omega/d\beta$) and the phase velocity ($v_p=\omega/\beta$) are zero. When the CRLH unit cell is balanced, these resonant frequencies coincide as shown in FIG. 2 and are expressed as:

$$\omega_{se}=\omega_{sh}=\omega_0, \qquad \text{Eq. (3)}$$

where $C_R L_L = C_L L_R$. At $\omega_{se}$ and $\omega_{sh}$, the positive group velocity ($v_g=d\omega/d\beta$) and the zero phase velocity ($v_p=\omega/\beta$) can be obtained. For the balanced case, the general dispersion curve can be expressed as:

$$\beta = \omega\sqrt{L_R C_R}\,\frac{1}{\omega\sqrt{L_L C_L}}. \qquad \text{Eq. (4)}$$

The propagation constant β is positive in the RH region, and that in the LH region is negative. Therefore, the LH properties are dominant in the low frequency region, and the RH properties are dominant in the high frequency region.

Generally in antenna designs, loading elements can be used to reduce antenna size. This is because electric current paths can be elongated due to the presence of loading elements, effectively providing the active antenna area similar to a larger size antenna. Examples of loading elements include conductive stubs or lines as additional transmission lines, which can provide either inductive or capacitive loads, or combinations of inductive loads and capacitive loads. A new class of loading elements or structures, which utilize CRLH metamaterial structures, is described below.

An antenna structure with a metamaterial (MTM) loading element can be configured to embody a CRLH unit cell, as shown in FIGS. 1A-1F, by using lumped electronic components, distributed elements, or combination of both. Applications can be made for a wide variety of antenna structures including, for example, monopole-type antennas, dipole-type antennas, and their variants such as IFA (Inverted F antenna), PIFA (Planar Inverted F antenna) and the like. As described below based on several exemplary implementations, loading a MTM element onto an antenna structure can result in the generation of additional frequency resonances, thereby providing the capability of dual-band or multiband operations with the compact size. Unlike non-MTM antennas, the MTM loaded antenna resonances are affected by the presence of the left-handed (LH) mode as shown in FIG. 2. In general, the LH mode helps excite and better match the low frequency resonances as well as improves the matching of high frequency resonances.

A monopole is a ground plane dependent antenna that is fed single-ended. The length of the monopole conductive trace (a radiating arm) primarily determines the resonant frequency of the antenna. The gain of the antenna varies depending on parameters such as the distance to the ground plane and size of the ground plane. A compact layout of a monopole antenna can be obtained by bending the radiating arm by about 90 degrees so that the bent portion becomes substantially in parallel with the ground plane edge. A dipole can be regarded as a combination of two mirror-imaged monopoles with the bent radiating arms. The dipole is normally center-fed by a feeding network. An IFA has the structure similar to the compact monopole structure having a bent radiating arm and additionally includes a shorting stub that is connected to the ground. The shorting stub serves to improve impedance matching. A PIFA can be regarded as a variant of an IFA in which the bent portion of the radiating arm is replaced by a conductive planar patch. Unlike an IFA, a typical PIFA has a ground plane that overlaps with a footprint projected by the conductive planar patch.

Figure 3A:
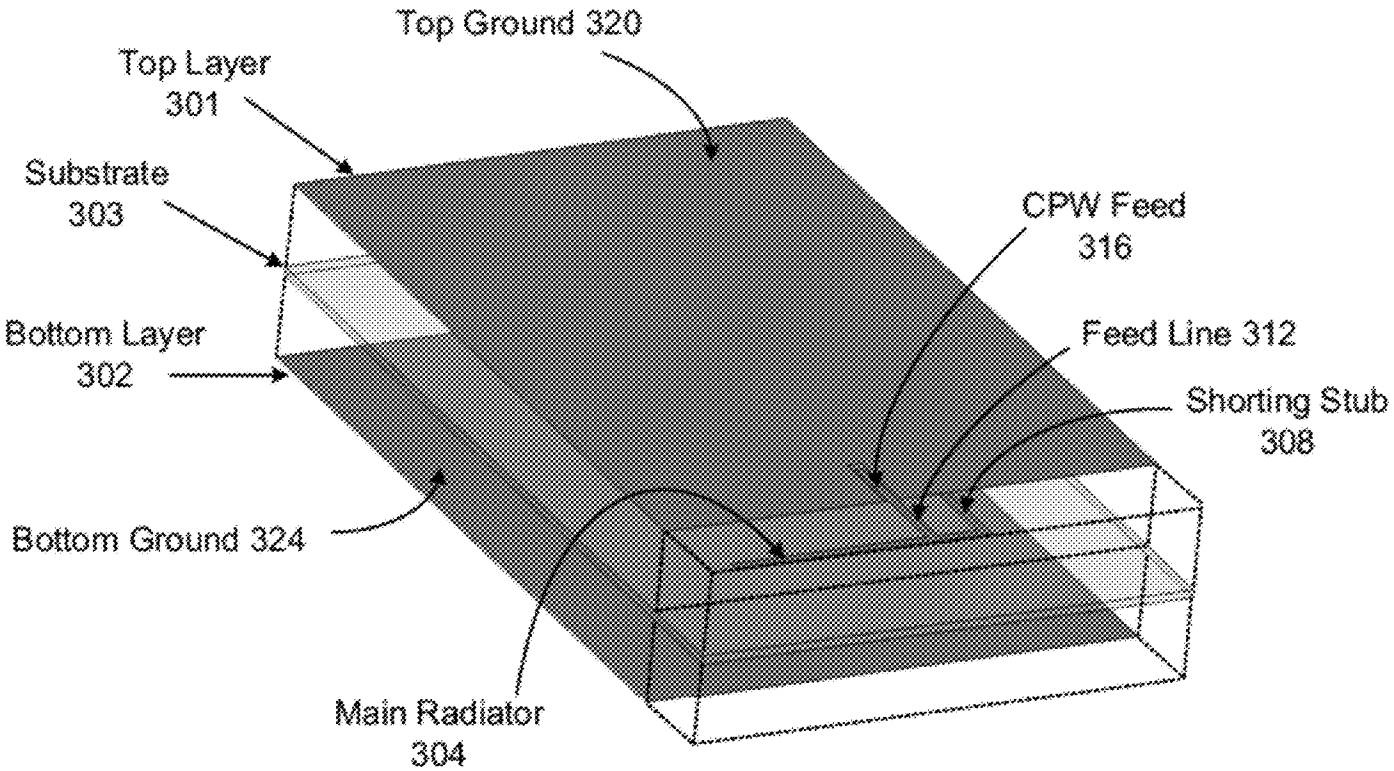
FIGS. 3A, 3B and 3C show an example of an inverted F antenna (IFA) structure in a 3-dimensional perspective view, a top view of the top layer, and a top view of the bottom layer, respectively.
Figures 3B, 3C:
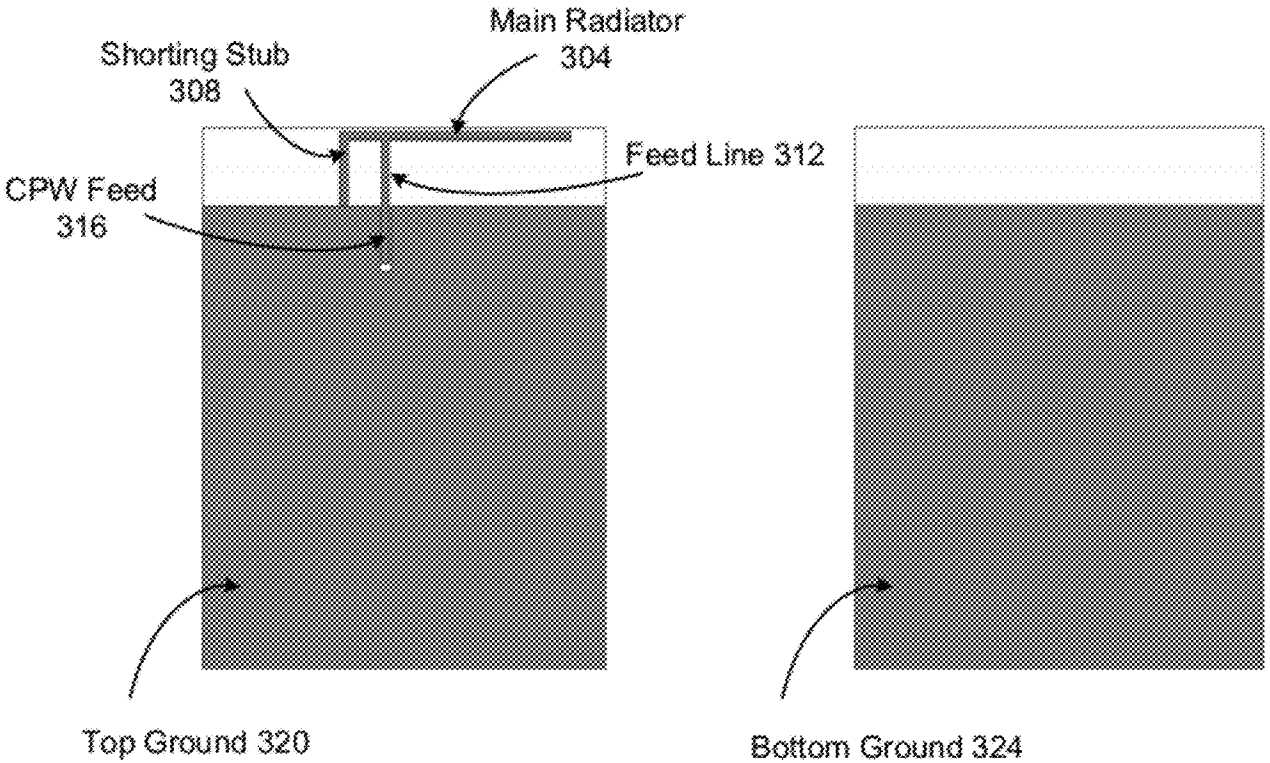

FIGS. 3A, 3B and 3C show an example of an IFA structure, illustrating the 3D view, top view of the top layer 301, and top view of the bottom layer 302, respectively. The substrate 303 has a first surface on which the top layer 301 is formed and a second surface on which the bottom layer 302 is formed. For the sake of clarity, in FIG. 3A, the top layer 301, substrate 302 and bottom layer 303 are shown separately with dotted lines connecting the corresponding points and lines when attached to one another. The IFA structure includes a main radiator 304, a shorting stub 308 and a feed line 312. The main radiator 304 is a conductive strip line that is directly connected to both the feed line 312 and the shorting stub 308 and has one open end. In this example, the feed line 312 has one end connected to a coplanar waveguide (CPW) feed 316 which is in communication with an antenna circuit that generates and supplies an RF signal to be transmitted out through the antenna, or receives and processes an RF signal received through the antenna. The other end of the feed line 312 is connected to the junction between the main radiator 304 and the shorting stub 308 to conduct the RF signal to or from the main radiator 304. The CPW feed 316 is formed in a top ground 320 paired with a bottom ground 324 as shown in FIGS. 3A-3C. All the examples and implementations provided in this document employ a CPW feed with top and bottom grounds. However, alternatively, the antenna can be fed with a different type of CPW feed that does not require a ground plane on a different layer or a different type of transmission lines. The shorting stub plays a role in compensating for the capacitance introduced between the main radiator and the ground, leading to better impedance matching of the IFA.

The following dimensions for one implementation of the antenna in FIGS. 3A-3C are given as an example. This IFA is formed on a 1 mm-thick FR-4 substrate with a dielectric constant of 4.4. The CPW feed 316 has dimensions of 1.2 mm×8 mm and is coupled to the top ground 320 over a gap of 0.254 mm in width.

The feed line 312 has dimensions of 1.2 mm×9.3 mm. The main radiator 304 is a rectangular patch with dimensions of 1.2 mm×28.2 mm. The shorting stub 308 is an L-shape patch that connects the junction between the main radiator 304 and the feed line 312 to the top ground 320. The section of the L-shaped shorting stub 308 connected to the junction has dimensions of 1.2 mm×6.2 mm, and the other section of the L-shaped shorting stub 308 connected to the top ground 320 has dimensions of 1.2 mm×9.3 mm.

Figure 4:
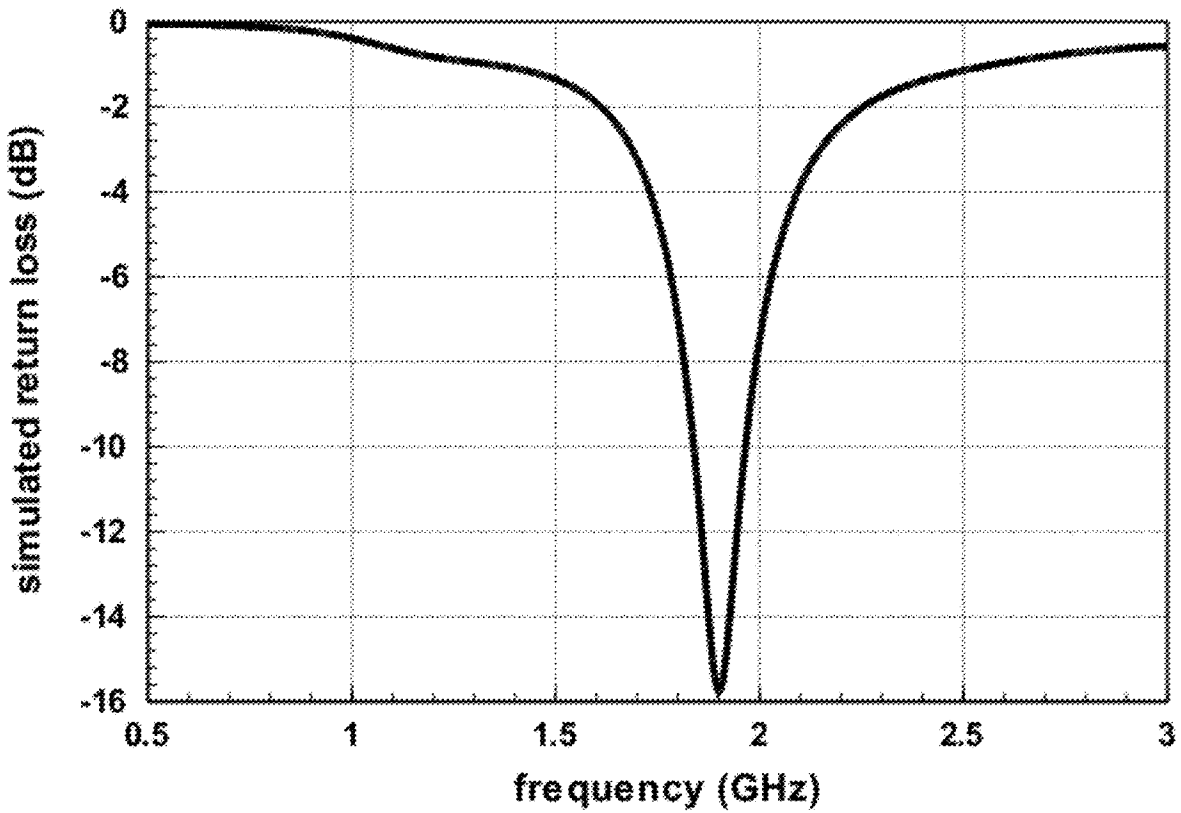
FIG. 4 shows the simulated return loss of the IFA shown in FIGS. 3A-3C.

FIG. 4 shows the simulated return loss of the IFA with the above geometry and dimensions. The return loss is better than −6 dB from 1.78 GHz to 2.02 GHz with the center frequency of 1.9 GHz, indicating that this antenna can support a single band.

Figure 5:
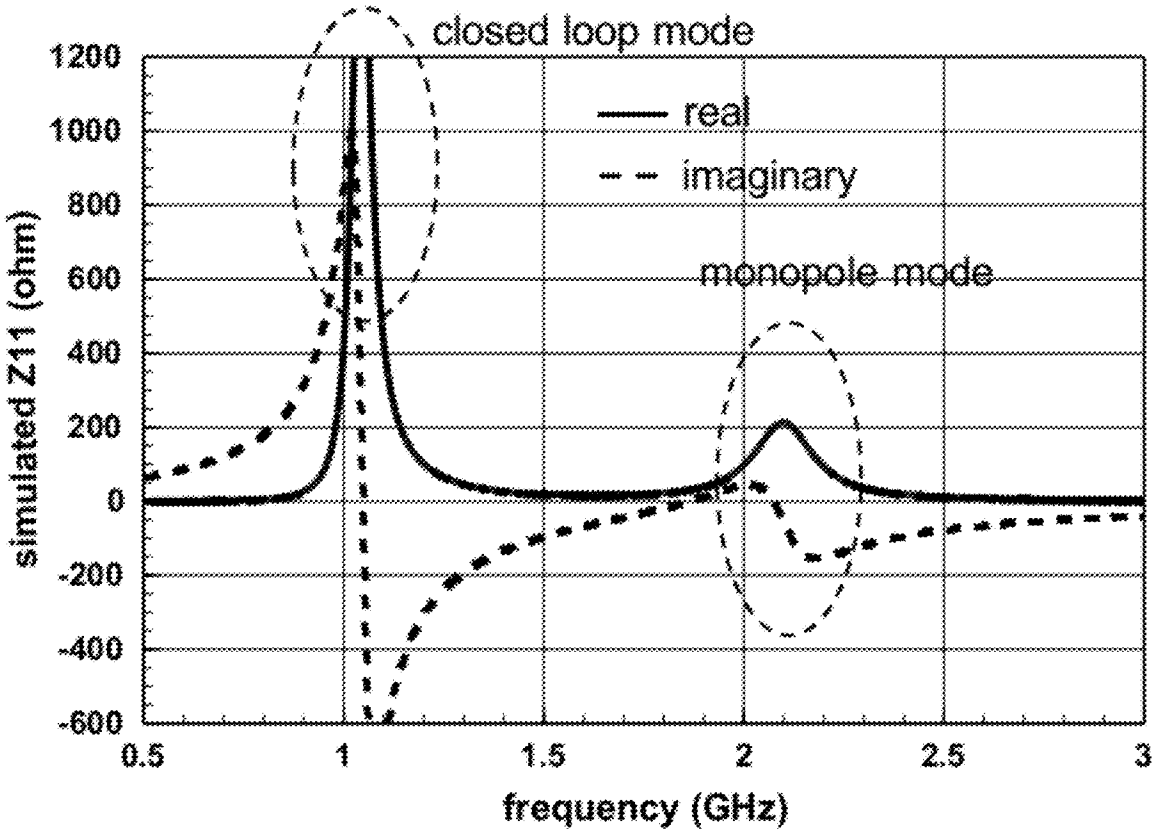
FIG. 5 shows the simulated input impedance of the IFA shown in FIGS. 3A-3C, illustrating the real and imaginary parts, in solid line and dashed line, respectively.

FIG. 5 shows the simulated input impedance of the IFA, illustrating the real and imaginary parts, in solid line and dashed line, respectively. This simulation shows two operating modes of the IFA in FIGS. 3A-3C: a monopole mode and a closed loop mode. The monopole mode is a radiating mode, in which the resonant frequency is determined mainly by the electrical lengths of the feed line 312 and main radiator 304. The closed loop mode is a non-radiating mode, in which the resonant frequency is determined mainly by the electrical length of the feed line 312, main radiator 304 and shorting stub 308.

Figure 6A:
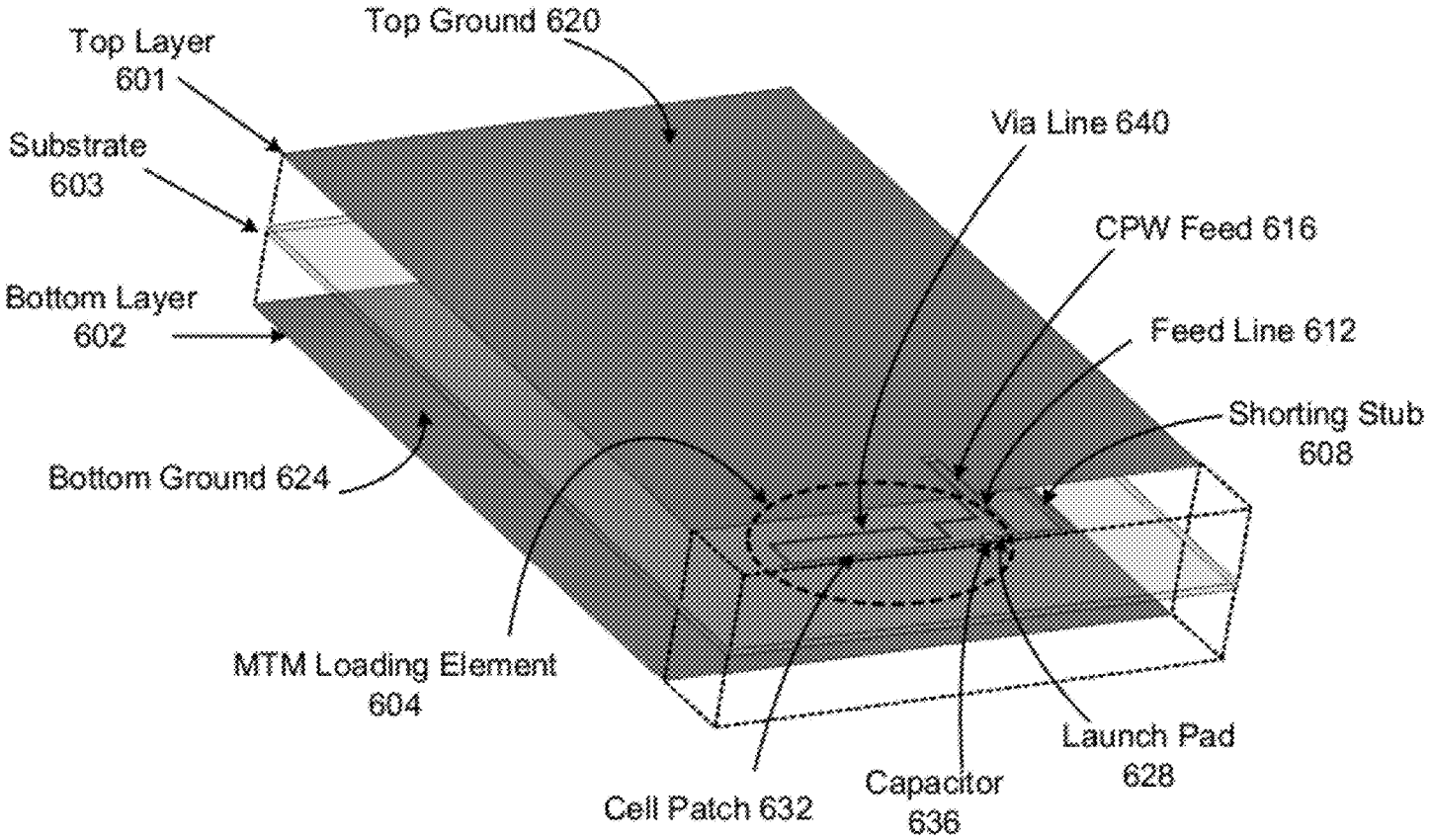
FIGS. 6A, 6B and 6C show an example of a MTM loaded IFA structure, illustrating the 3D view, top view of the top layer, and top view of the bottom layer, respectively.
Figures 6B, 6C:
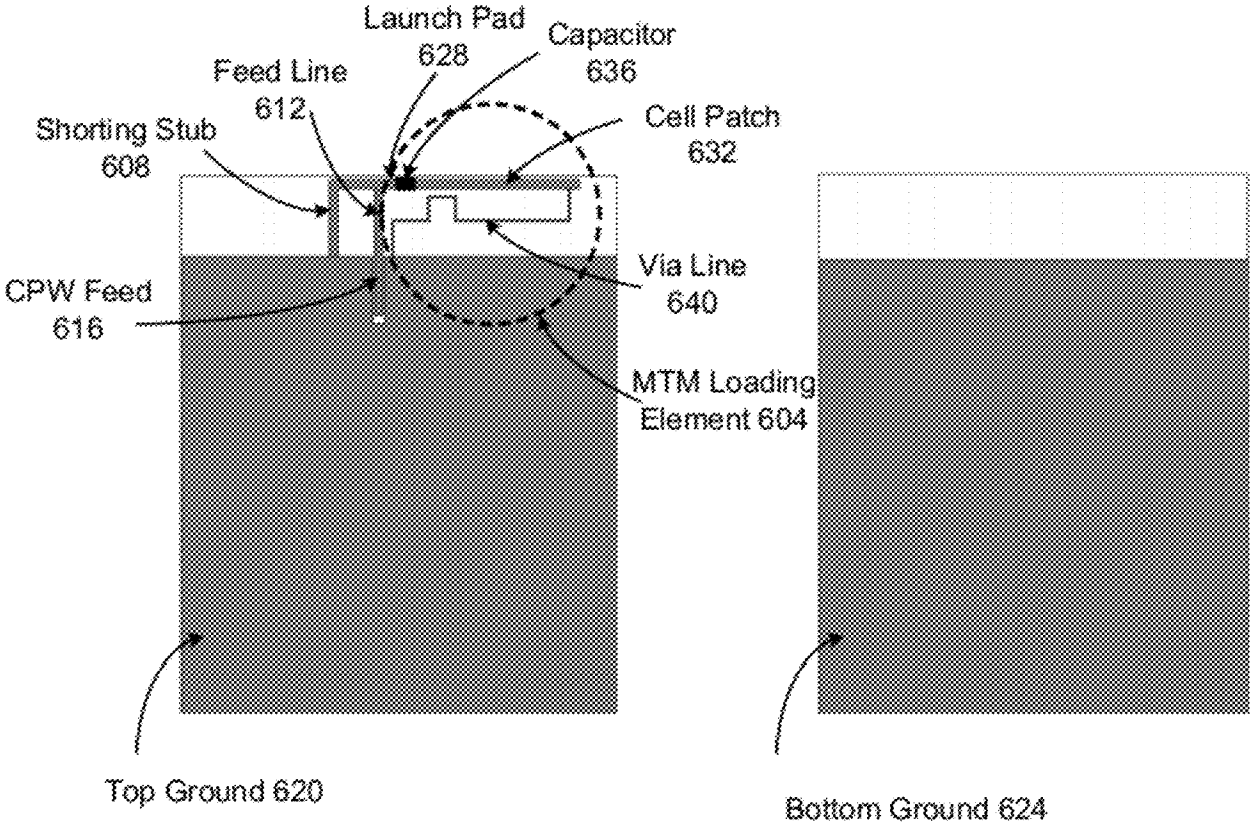

FIGS. 6A, 6B and 6C show an example of a MTM loaded IFA structure, illustrating the 3D view, top view of the top layer 601, and top view of the bottom layer 602, respectively. The substrate 603 has a first surface on which the top layer 601 is formed and a second surface on which the bottom layer 602 is formed. In FIG. 6A, the top layer 601, substrate 602 and bottom layer 603 are shown separately with dotted lines connecting the corresponding points and lines when attached to one another. This MTM loaded IFA structure includes a MTM loading element 604, a shorting stub 608 and a feed line 612. The feed line 612 has one end connected to a CPW feed 616 which is in communication with an antenna circuit that generates and supplies an RF signal to be transmitted out through the antenna, or receives and processes an RF signal received through the antenna. The other end of the feed line 612 is connected to the junction between the MTM loading element 604 and the shorting stub 608 to conduct the RF signal to or from the MTM loading element 604. The CPW feed 616 is formed in a top ground 620 paired with a bottom ground 624 as shown in FIGS. 6A-6C. The MTM loading element 604 includes a launch pad 628, a cell patch 632, a capacitor 636 and a via line 640. The via line 640 connects the cell patch 632 to the top ground 620. The capacitor 636 provides the LH series capacitance $C_L$, and the via line 640 provides the LH shunt inductance $L_L$. The cell patch 632 is a part of the RF transmitting and receiving structure of this MTM loaded IFA that receives an RF signal from the air or transmits an RF signal into the air. The launch pad 628 and the cell patch 632 are coupled through the capacitor 636 to conduct the RF signal. The main radiator 304 of the IFA in FIGS. 3A-3C is replaced by the MTM loading element 604 in this implementation shown in FIGS. 6A-6B. Thus, the antenna structure shown in FIGS. 6A-6B can be viewed as an IFA loaded with a MTM structure. The MTM loading element 604 can include a dielectric gap or a capacitor 636 between the cell patch 632 and the launch pad 628 to provide capacitive coupling. In this example and other examples in this document, the MTM loading element 604 and the feed line 612 are structured to collectively form a CRLH MTM structure, and the MTM loading element 604 forms part of the radiating or receiving structure of the antenna.

The following dimensions for various parts are given as an example. The antenna structure is formed on a 1 mm thick FR-4 substrate with a dielectric constant of 4.4. The CPW feed 616 has dimensions of 1.2 mm×8 mm and a gap of 0.254 mm in width to the top ground 620. The feed line 612 has dimensions of 1.2 mm×9.3 mm. The shorting stub 608 is an L-shape patch that connects the junction between the MTM loading element 604 and the feed line 612 to the top ground 620. One section of the L-shaped shorting stub 608 connected to the junction is 1.2 mm×6.2 mm, and the other section of the L-shaped shorting stub 608 connected to the top ground 620 is 1.2 mm×9.3 mm. The shorting stub 608 facilitates impedance matching of this MTM loaded IFA structure. For the MTM loading element 604, one end of the launch pad 628 is connected to the junction between the feed line 612 and the shorting stub 608, while the other end is connected to the capacitor 636. The launch pad 628 has dimensions of 1.2 mm×2.15 mm. One end of the cell patch 632 is coupled to the capacitor 636 and the other end is left open. The cell patch 632 has dimensions of 1.2 mm×24.35 mm. The capacitor 636 has a capacitance value of 0.3 pF. The capacitor 636 can be omitted by structuring the shapes and dimensions of the launch pad 628 and the cell patch 632 to form a dielectric gap to provide capacitive coupling suitable for achieving desired frequency resonances and impedance matching. Thus, the launch pad 628 and the cell patch 632 can be regarded as a pair of conductive patches separated by a dielectric medium and coupled capacitively to conduct the RF signal. The via line 640 is attached to the cell patch 632 at 1.15 mm away from the open end of the cell patch 632. The width of the via line 640 is 0.3 mm, and the total length is 40.3 mm. The via line 640 is bent at several places in this example to reduce the occupied space and at the same time to provide a sufficient inductance suitable for achieving desired frequency resonances and impedance matching.

Figure 7:
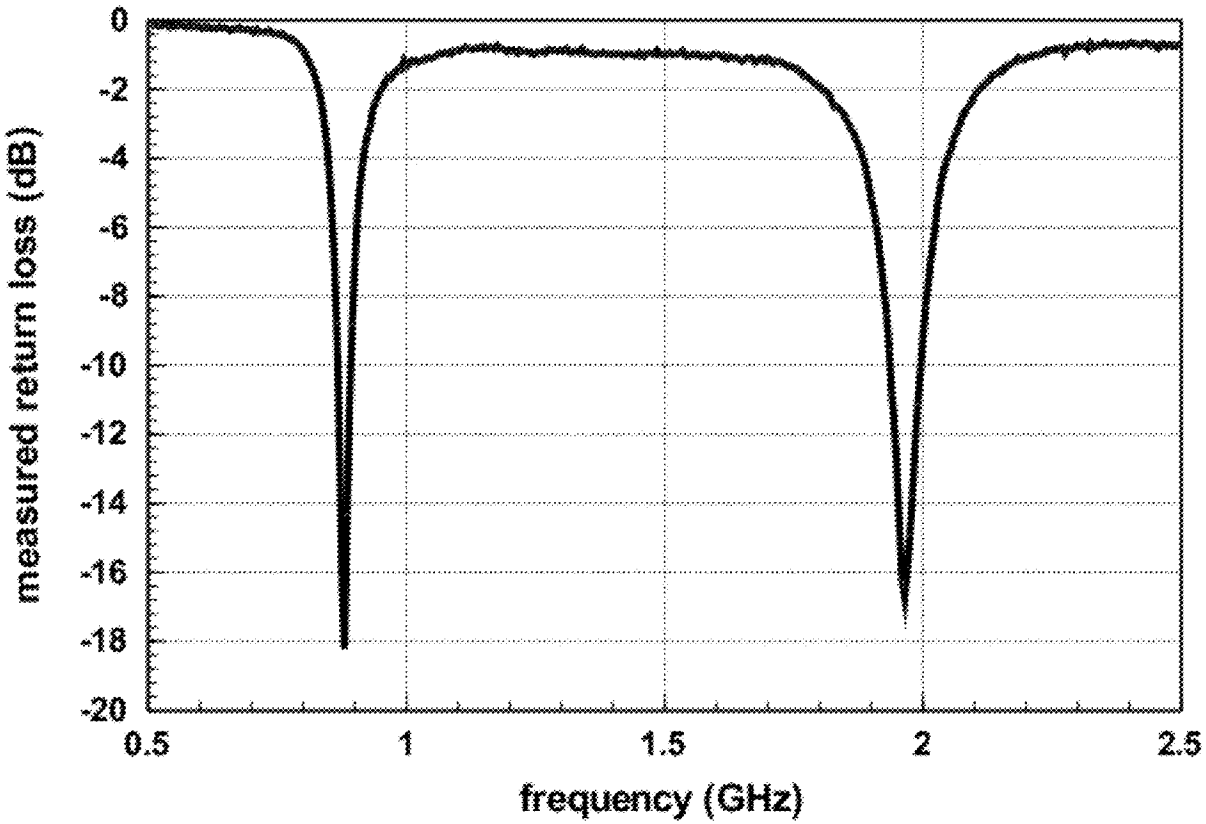
FIG. 7 shows the measured return loss of the MTM loaded IFA structure shown in FIGS. 6A-6C.

FIG. 7 shows the measured return loss of the MTM loaded IFA structure shown in FIGS. 6A-6C. The measurements indicate that this MTM loaded IFA structure generates two frequency resonances at 0.87 GHz and 1.96 GHz. The return loss is better than −6 dB in the low band from 0.85 GHz to 0.9 GHz and in the high band from 1.9 GHz to 2.02 GHz, indicating that this antenna can support a dual band operation at the low and high bands.

Figure 8:
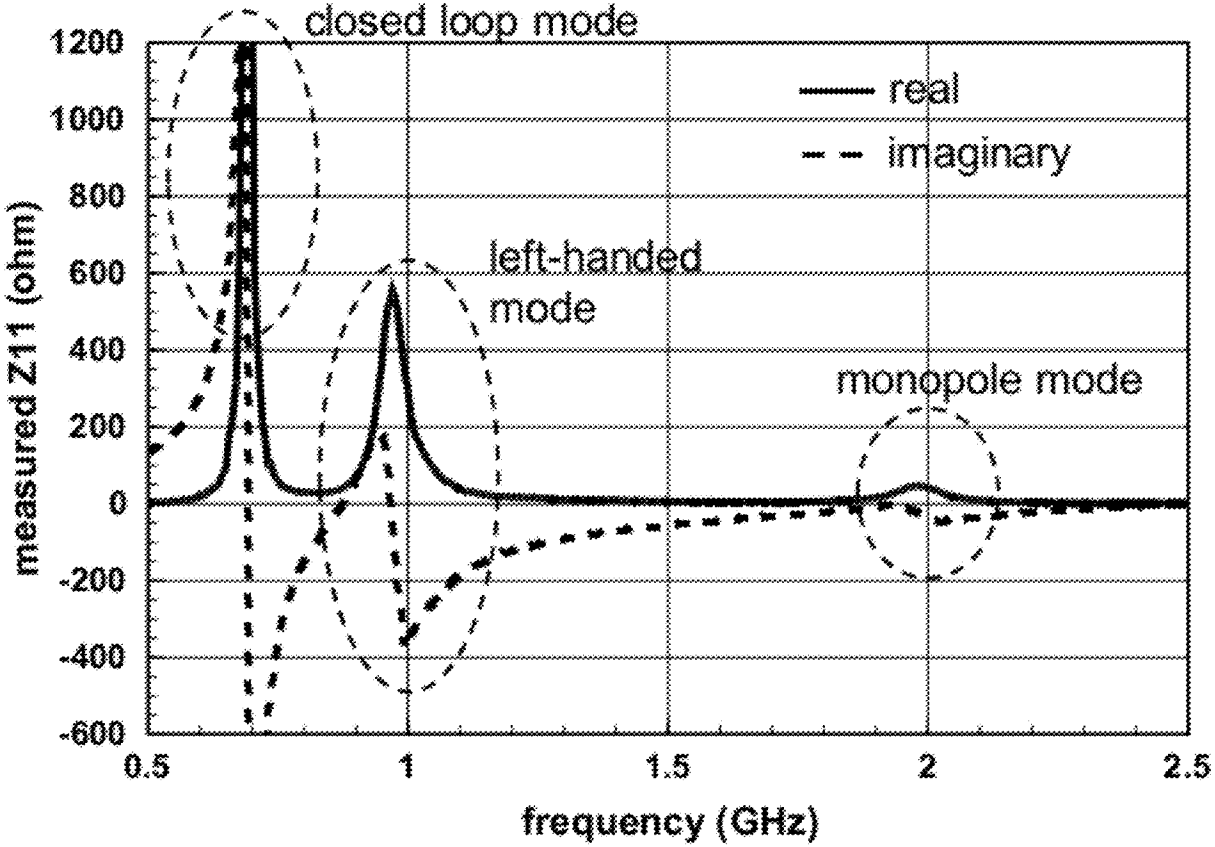
FIG. 8 shows the measured input impedance of the MTM loaded IFA structure in FIGS. 6A-6C, illustrating the real and imaginary parts, in solid line and dashed line, respectively.

FIG. 8 shows the measured input impedance of the MTM loaded IFA structure in FIGS. 6A-6C, illustrating the real and imaginary parts, in solid line and dashed line, respectively. This figure shows three different modes. The highest frequency mode is a monopole RH mode, in which the resonant frequency is mainly determined by the electrical lengths of the feed line 612, launch pad 628 and cell patch 632 and the value of the capacitor 636. The middle mode is a LH mode, in which the resonant frequency is mainly determined by the electrical lengths of the feed line 612, launch pad 628, cell patch 632 and via line 640 and the value of the capacitor 636. The lowest mode is a non-radiating, closed-loop mode, in which the resonant frequency is mainly determined by the electrical lengths of the feed line 612, launch pad 628, cell patch 632, via line 640 and shorting stub 608 and the value of the capacitor 636.

Figure 9:
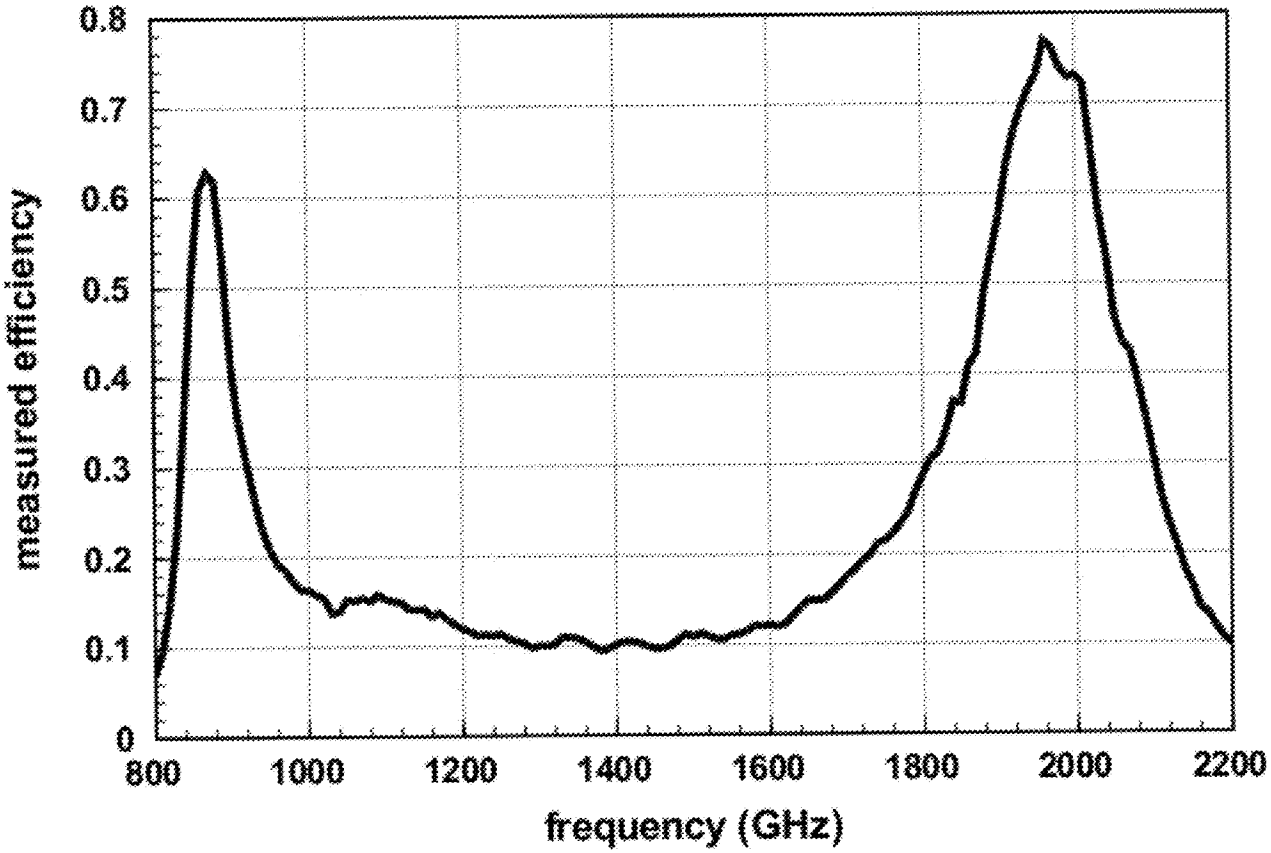
FIG. 9 shows the measured radiation efficiency of the MTM loaded IFA structure in FIGS. 6A-6C.

FIG. 9 shows the measured radiation efficiency of the MTM loaded IFA structure in FIGS. 6A-6C, illustrating the good radiation efficiency especially at 0.87 GHz and 1.96 GHz for the dual band.

As shown in FIGS. 7, 8 and 9, the MTM loaded IFA structure shown in FIGS. 6A-6C occupy about the same area as the non-MTM IFA shown in FIGS. 3A-3C. However, two frequency resonances are generated at about 1.9 GHz and 0.87 GHz, respectively, providing the capability of supporting a dual-band operation using one antenna. In comparison, various non-MTM antennas use two separate antennas to support a dual band operation at two frequency bands. Hence, the present MTM designs can provide a single MTM antenna for supporting two or more different bands. Notably, adding a MTM loading element in a non-MTM antenna can generate a LH mode while preserving the monopole RH mode associated with the original non-MTM antenna. In addition, FIG. 9 indicates that the antenna size can be reduced without sacrificing the radiation efficiency, although the antenna size and efficiency in many non-MTM antennas have a trade-off relationship in which a reduction in size reduces the antenna efficiency.

Figure 10A:
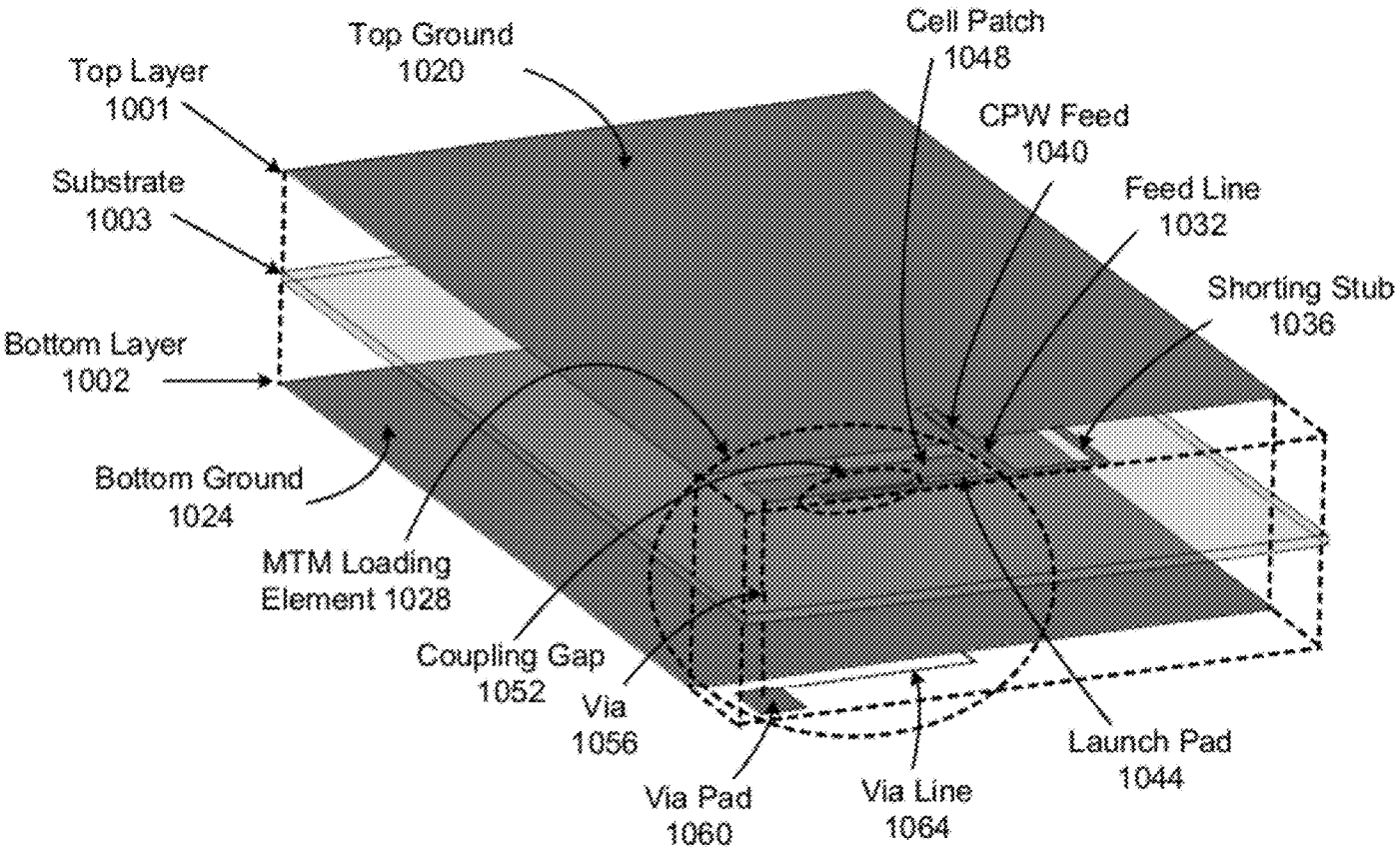
FIGS. 10A, 10B and 10C show another example of a MTM loaded IFA structure, illustrating the 3D view, top view of the top layer, and bottom view of the bottom layer, respectively.
Figures 10B, 10C:
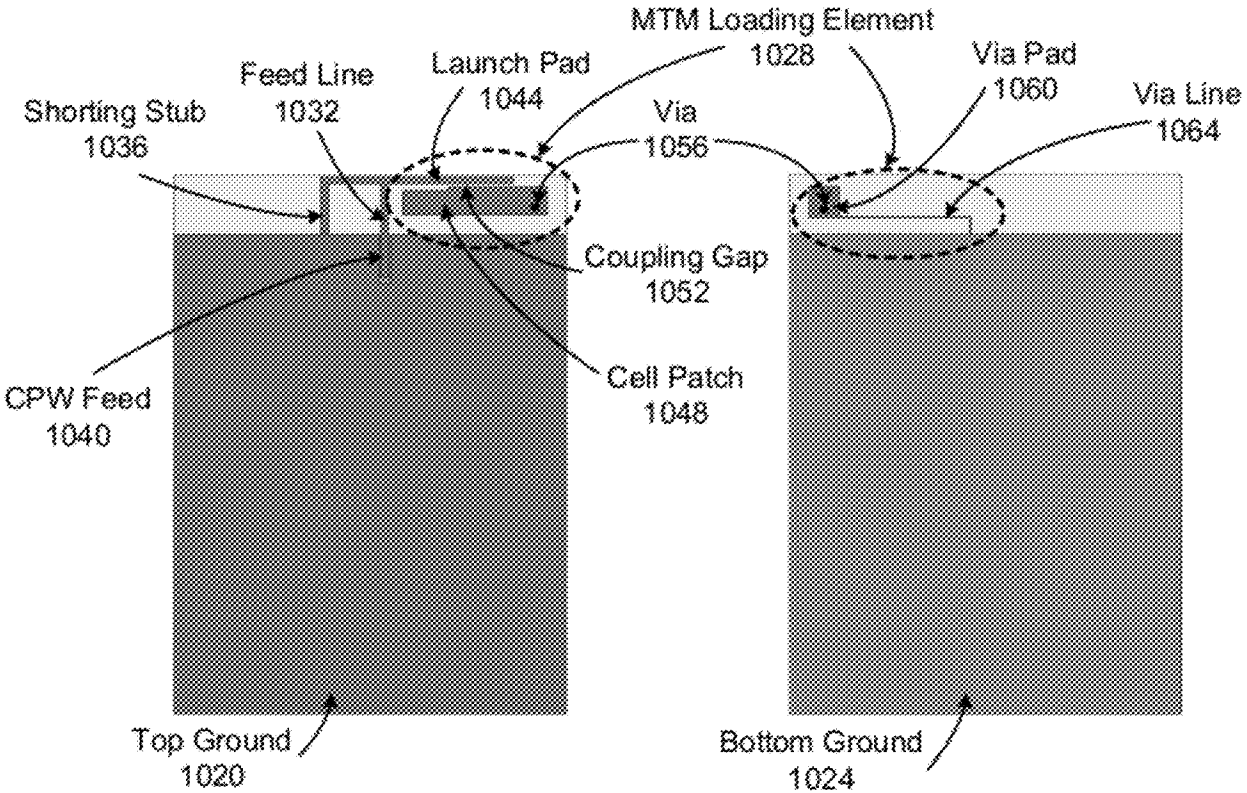

FIGS. 10A, 10B and 10C show another example of a MTM loaded IFA structure, illustrating the 3D view, top view of the top layer 1001, and bottom view of the bottom layer 1002, respectively. The substrate 1003 has a first surface on which the top layer 1001 is formed and a second surface on which the bottom layer 1002 is formed. In FIG. 10A, the top layer 1001, substrate 1002 and bottom layer 1003 are shown separately with dotted lines connecting the corresponding points and lines when attached to one another. This design can increase the bandwidth of the high band.

Specifically, this MTM structure includes a MTM loading element 1028, a feed line 1032 and a shorting stub 1036. The feed line 1032 has one end connected to a CPW feed 1040 which is in communication with an antenna circuit that generates and supplies an RF signal to be transmitted out through the antenna, or receives and processes an RF signal received through the antenna. The other end of the feed line 1032 is connected to the junction between the MTM loading element 1028 and the shorting stub 1036 to conduct the RF signal to or from the MTM loading element 1028. The CPW feed 1040 is formed in a top ground 1020 paired with a bottom ground 1024 as shown in FIGS. 10A-10C. The dimensions below are given as an example. The antenna structure is formed on a 1 mm thick FR-4 substrate with a dielectric constant of 4.4. The CPW feed 1040 has dimensions of 1.2 mm×8 mm and a gap of 0.254 mm in width to the top ground 1020. The feed line 1032 has dimensions of 1.2 mm×9.3 mm. The shorting stub 1036 is an L-shape patch that connects the junction between the MTM loading element 1028 and the feed line 1032 to the top ground 1020. The section of the L-shaped shorting stub 1036 connected to the junction is 1.2 mm×6.2 mm, and the other section of the L-shaped shorting stub 1036 connected to the top ground 1020 is 1.2 mm×9.3 mm. The shorting stub 1036 facilitates the impedance matching.

The MTM loading element 1028 includes a launch pad 1044, a cell patch 1048, a coupling gap 1052, a via 1056, a via pad 1060 and a via line 1064. One end of the launch pad 1044 is connected to the junction between the feed line 1032 and shorting stub 1036, and the other end is left open. The via 1056 is a conductor that penetrates the substrate 1003 to connect the via pad 1060 on the bottom surface of the substrate 1003 to the cell patch 1048 on the top surface of the substrate 1003.

The following dimensions are given as an example. The launch pad 1044 has a rectangular shape with dimensions of 1.2 mm×20.2 mm. The cell patch 1048 is made of a rectangular shaped patch that has a rectangular cut at one corner. The rectangular shaped patch has dimensions of 5.3 mm×22 mm and the rectangular cut has dimensions of 0.8 mm×7 mm. The launch pad 1044 and cell patch 1048 are capacitively coupled through a coupling gap 1052 with 0.5 mm in width and 9.85 mm in length. A capacitor can be inserted in the coupling gap 1052 or used to replace the coupling gap 1052 by structuring the shapes and dimensions of the launch pad 1044, the cell patch 1048 and the coupling gap 1052 to provide capacitive coupling suitable for achieving desired frequency resonances and impedance matching. Thus, the launch pad 1044 and the cell patch 1048 can be regarded as a pair of conductive patches separated by a dielectric medium and coupled capacitively to conduct the RF signal. The cell patch 1048 is connected to the bottom ground 1024 through the via 1056, via pad 1060 and via line 1064. The via 1056 has a radius of 0.127 mm and is located at 1.4 mm away from the right edge of the cell patch 1048 and 2.9 mm away from the top edge of the cell patch 1048. The via pad 1060 is formed on the bottom side of the substrate and is rectangular in shape with dimensions of 4.65 mm×5.8 mm. The via line 1064 is also formed on the bottom side of the substrate and is attached at the corner of the via pad 1060 and connected to the bottom ground 1024. The via line 1064 has 0.2 mm in width and 23.2 mm in total length. This via line 1064 is bent at one place to reduce the occupied space.

Figure 11:
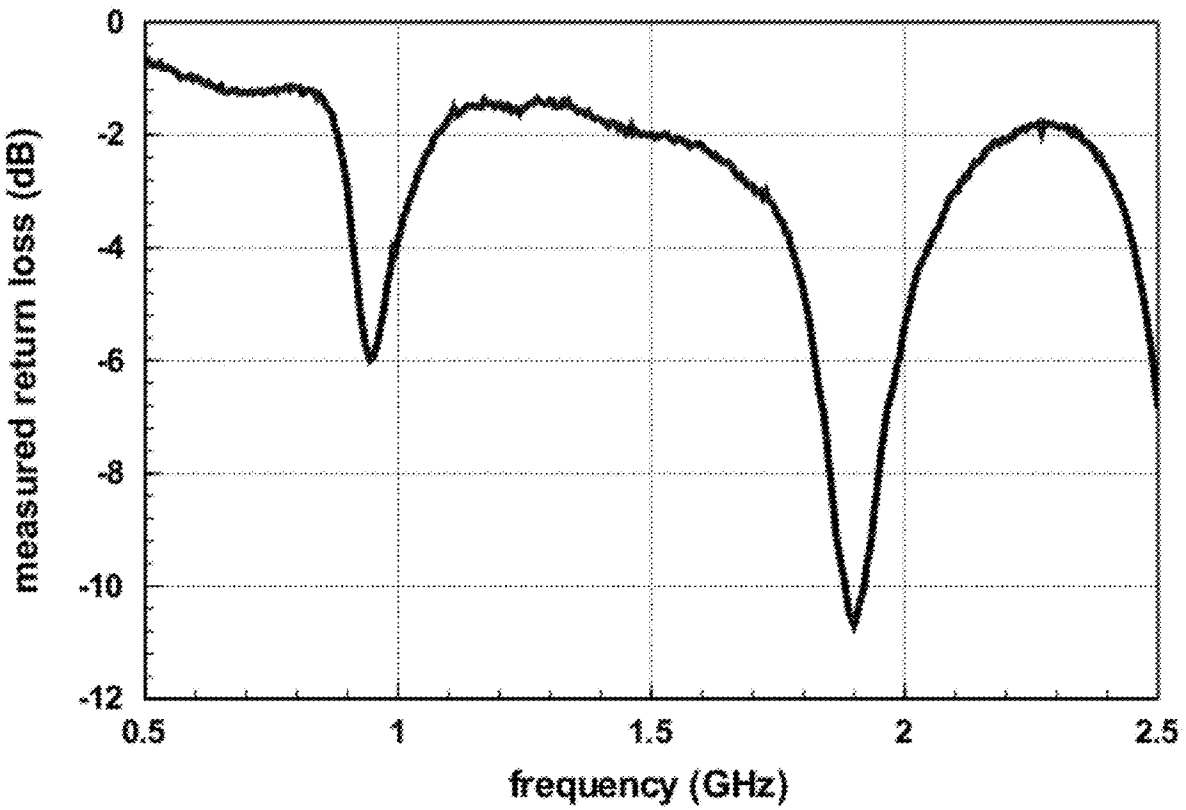
FIG. 11 shows the measured return loss of the MTM loaded IFA structure shown in FIGS. 10A-10C.

FIG. 11 shows the measured return loss of the MTM loaded IFA structure shown in FIGS. 10A-10C. As can be seen from this result, this antenna supports two bands centered at 0.94 GHz and 1.90 GHz. The return loss is better than −6 dB in the high band from 1.82 GHz to 1.99 GHz, which has the bandwidth wider than that of the MTM loaded IFA structure shown in FIG. 7.

Figure 12:
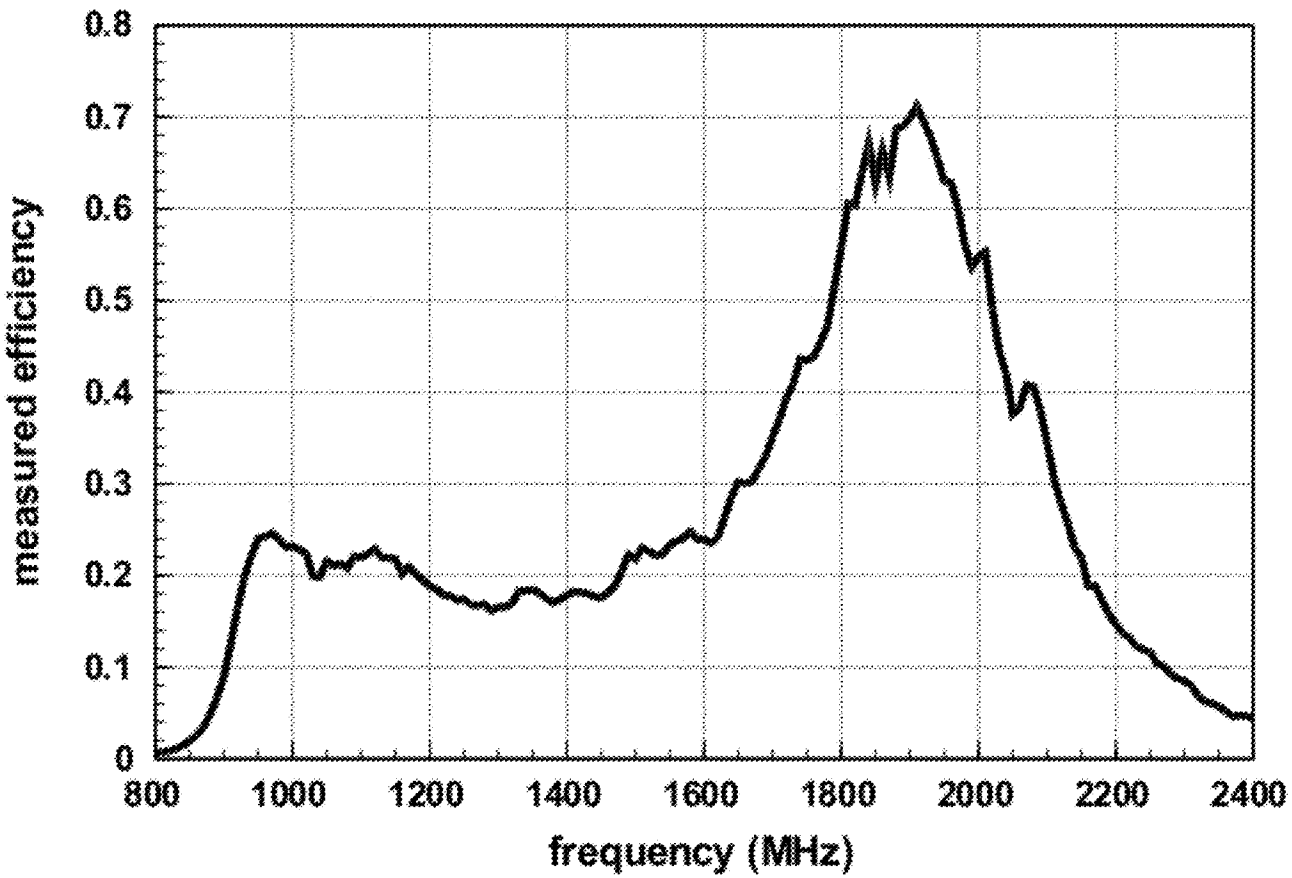
FIG. 12 shows the measured radiation of the MTM loaded IFA structure shown in FIGS. 10A-10C.
Figure 13A:
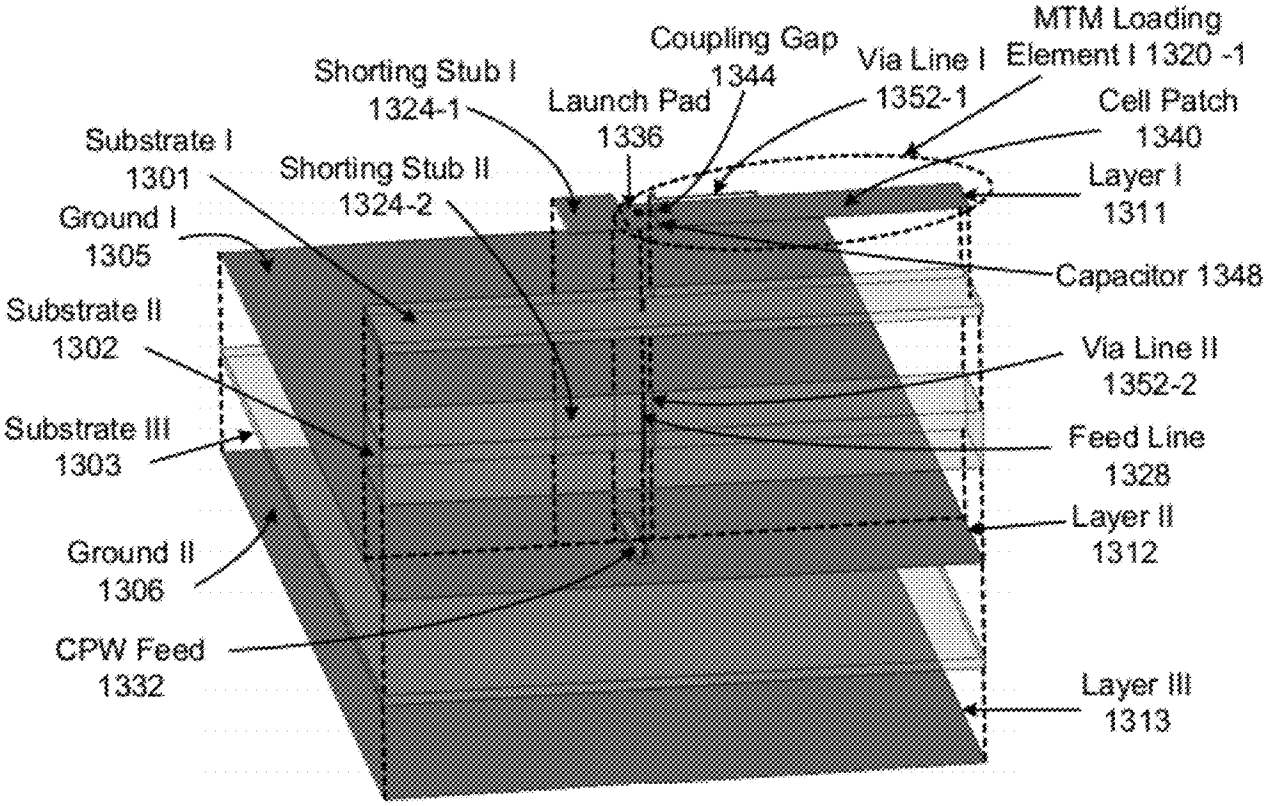
FIGS. 13A-13D show an example of a MTM loaded PIFA structure, illustrating the 3D view, side view, top view of the layer I, and top view of the layer II 1312, respectively
Figure 13B:
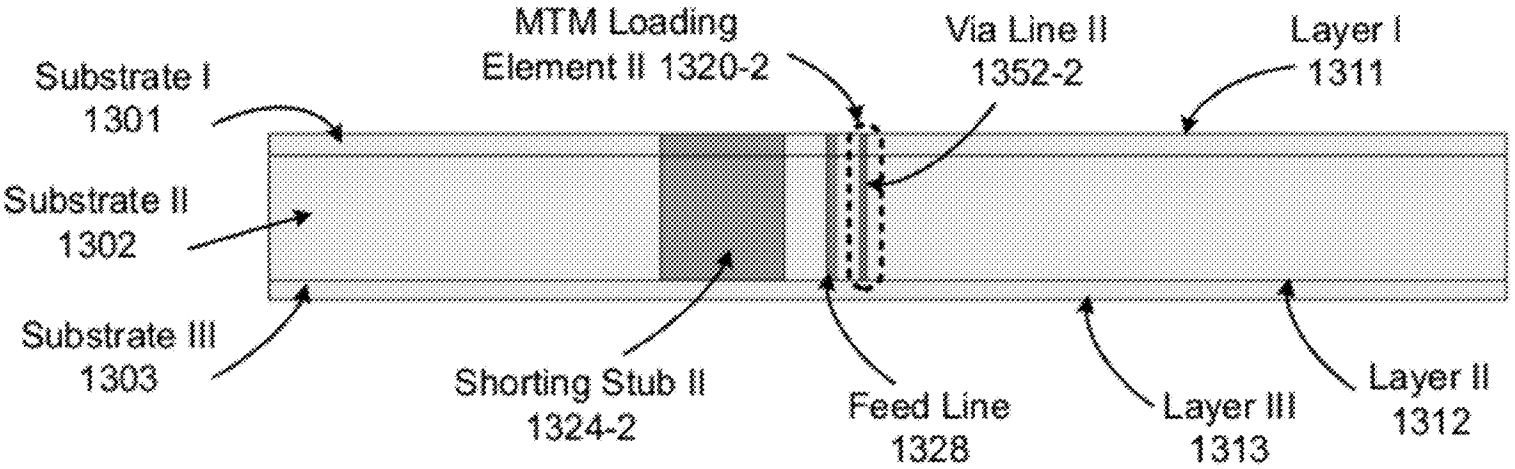
Figure 13C:
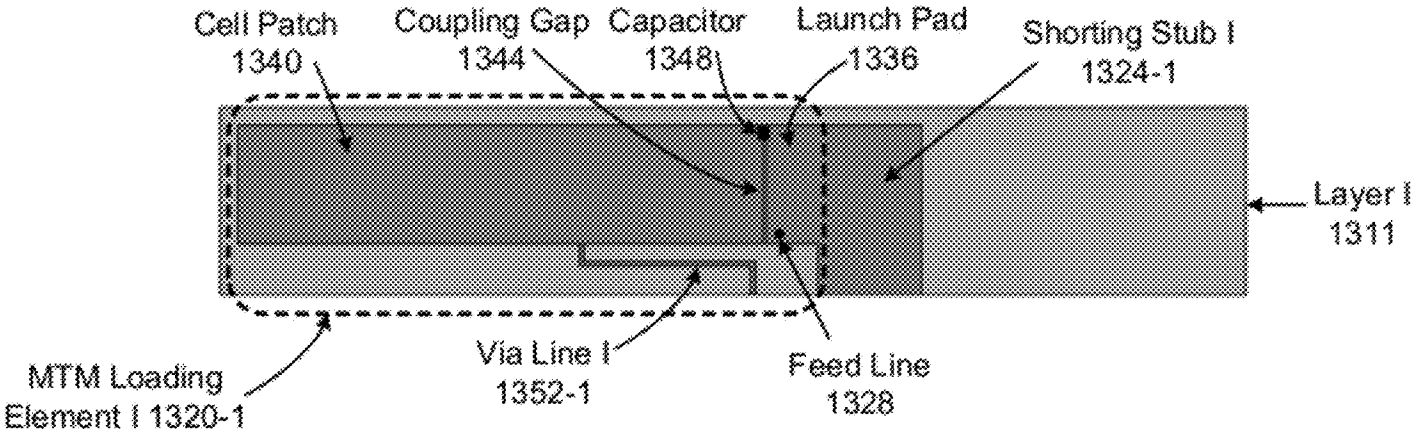
Figure 13D:
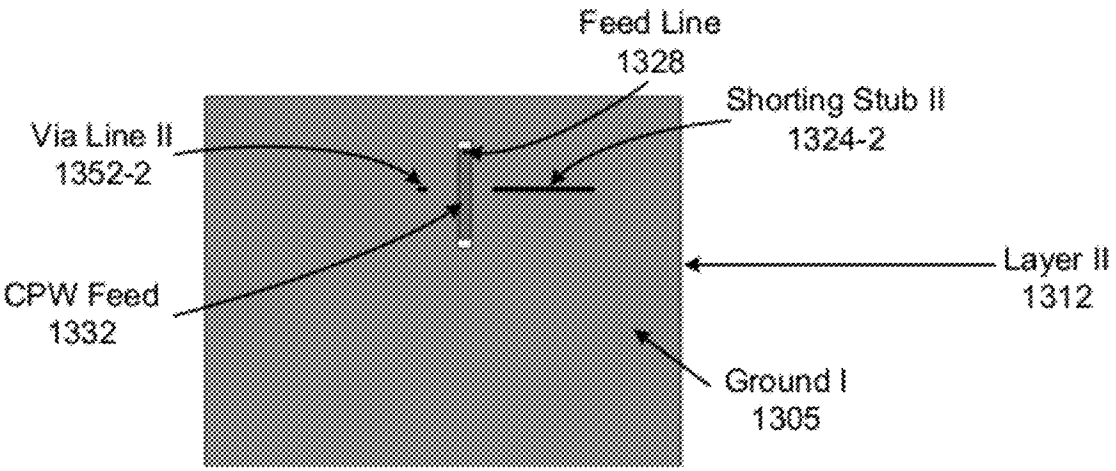

FIG. 12 shows the measured radiation efficiency from 0.8 GHz to 2.4 GHz of the MTM loaded IFA structure shown in FIGS. 10A-10C. It can be seen from this figure that the MTM loaded IFA structure in FIGS. 10A-10C radiates well at 0.94 GHz in the low band and 1.90 GHz in the high band for the dual-band operation. In addition, FIG. 12 confirms that the MTM loaded IFA structure in FIGS. 10A-10C has the bandwidth wider than that of the MTM loaded IFA structure in FIGS. 6A-6C, while the low resonance is preserved.

FIGS. 13A-13D show an example of a MTM loaded PIFA structure, which is a multi-layer structure constructed with three substrates (substrate I 1301, substrate II 1302, and substrate III 1303). Three metallization layers (Layer I, Layer II and Layer III) are formed in association with the substrates:

Layer I 1311 is formed on the top surface of the substrate I 1301; layer II 1312 is formed on the top surface of the substrate III 1303 and engaged with the bottom surface of the substrate II 1302; and layer III 1313 is formed on the bottom surface of the substrate III 1303. FIGS. 13A-13D show the 3D view, side view, top view of the layer I 1311, and top view of the layer II 1312, respectively. As illustrated, this exemplary structure includes a MTM loading element 1320, a shorting stub 1324 and a feed line 1328. The MTM loading element 1320 has a planar portion, the MTM loading element I 1320-1, formed in the layer I 1311 and a vertical portion, the MTM loading element II 1320-2, penetrating through the substrate I 1301 and the substrate II 1302 and terminated at the layer II 1302. The top planar portion of the shorting stub 1324 is formed in the layer I 1311 and denoted as a shorting stub I 1324-1, and the vertical portion is formed through the substrate I 1301 and the substrate II 1302, terminated at the layer II 1312, and denoted as a shorting stub II 1324-2. The feed line 1328 is formed through the substrate I 1301 and the substrate II 1302, terminated at the layer II 1312, and connected to a CPW feed 1332 to deliver power to the MTM loading element 1320. The CPW feed 1332 is formed in the layer II 1312. A ground I 1305 is formed in the layer II 1312 and a ground II 1306 is formed in the layer III 1313 to support the CPW feed 1332. Each of the ground I 1305 and the ground II 1306 in this example is a full ground that covers the entire surface of the substrate III without leaving an exposed surface portion. The ground II 1306 can be omitted if a feed port different from a CPW feed that requires an additional ground on a different plane is employed. In this case, only the ground I 1305 can be structured to be a full ground. In one implementation, for example, both the substrate 11301 and substrate III 1303 are a 1 mm FR-4 PCB with a dielectric constant of 4.4. The substrate II 1302 is an air layer or a styrofoam layer which is 6 mm thick with a dielectric constant of 1. The width and length of the CPW feed 1332 are 1.2 mm×12 mm, and the gap to the ground I 1305 is 0.254 mm in width. A portion of the CPW feed 1332 overlaps with the footprint projected by the substrate II 1302. This portion is 1.2 mm×4 mm.

In the present implementation example, the MTM loading element 1320 includes a launch pad 1336, a cell patch 1340, a coupling gap 1344, a capacitor 1348, and a via line I 1352-1 and a via line II 1352-2. The MTM loading element I 1320-1 includes the launch pad 1336, the cell patch 1340, the coupling gap 1344, the capacitor 1348, and the via line I 1352-1 in the layer I. The MTM loading element II 1320-2 includes the via line II 1352-2 penetrating through the substrates I 1301 and II 1302. The launch pad 1336 is formed in the layer I 1311 and is connected to the CPW feed 1332 in the layer II 1312 by the feed line 1328. In one implementation, the launch pad 1336 can have dimensions of 3.104 mm×7 mm. The center of the feed line 1328 is located at 0.5 mm away from the bottom edge and 0.854 mm away from the left edge of the launch pad 1336 in FIG. 13C. The radius of the feed line 1328 is 0.254 mm. The cell patch 1340 is formed in the layer 11311 and is coupled to the launch pad 1336 through the coupling gap 1344 with dimensions of 0.15 mm×7 mm. The coupling can be adjusted by adding a capacitor 1348 across the coupling gap 1344. The capacitor 1348 is a lumped element which has a capacitance value of 1 pF. The capacitor 1348 can be omitted by structuring the shapes and dimensions of the launch pad 1336, the cell patch 1340 and the coupling gap 1344 to provide capacitive coupling suitable for achieving desired frequency resonances and impedance matching. Thus, the launch pad 1336 and the cell patch 1340 can be regarded as a pair of conductive patches separated by a dielectric medium and coupled capacitively to conduct the RF signal. The cell patch 1340 is connected to the ground I 1305 in the layer II 1312 through the via line I 1352-1 and the via line II 1352-2. The via line I 1352-1 is a conductive strip which is formed in the layer I 1311. The via line I 1352-1 is attached to the cell patch 1340 at 20 mm away from the left side edge in FIG. 13C. The via line I 1352-1 has dimensions of 0.3 mm×13 mm. The via line II 1352-2 connects the via line I 1352-1 in the layer I 1311 to the ground 11305 in the layer II 1312, and has dimensions of 0.3 mm×7 mm. The impedance matching is enhanced by adding the shorting stubs 11324-1 and II 1324-2 connecting the launch pad 1336 in the layer I 1311 to the ground I in the layer II 1312. The shorting stub I 1324-1 is connected to the launch pad 1336 in the layer I 1311 and has dimensions of 6 mm×10 mm. The shorting stub II 1324-2 is formed vertical to the shorting stub I 1324-1 and connects the shorting stub I 1324-1 in the layer I 1311 to the ground I 1305 in the layer II 1312. The shorting stub II 1324-2 has dimensions of 6 mm×7 mm.

In the multi-substrate structure shown in FIGS. 13A-13D, the feed line 1328 is formed vertical to the substrate surfaces and connects the CPW feed 1332 and the launch pad 1336 on different surfaces, and the part of the via line (via line II 1352-2) is also formed vertical to the substrate surfaces and connects the other part of the via line (via line I 1352-1) and the ground I 1305. A variation can be made by using the bottom surface of the substrate I 1301 to accommodate the launch pad 1336, the cell patch 1340, the shorting stub I 1324-1, the via line I 1352-1, and the associated coupling. The air gap or a styrofoam is sandwiched between the substrates I and III in the above example. Alternatively, a different type of dielectric material, such as a plastic spacer or a substrate with a dielectric constant different from the substrates I and III, can be used for the substrate II. Furthermore, the via line can be modified to have only the vertical portion (via line II 1352) directly connecting the cell patch 1340 in the layer I 1311 to the ground I 1305 in the layer II 1312. Similarly, the shorting stub can be modified to have only the vertical portion (shorting stub II 1324-2) directly connecting the launch pad 1336 in the layer I 1311 to the ground I 1305 in the layer II 1312.

Figure 14:
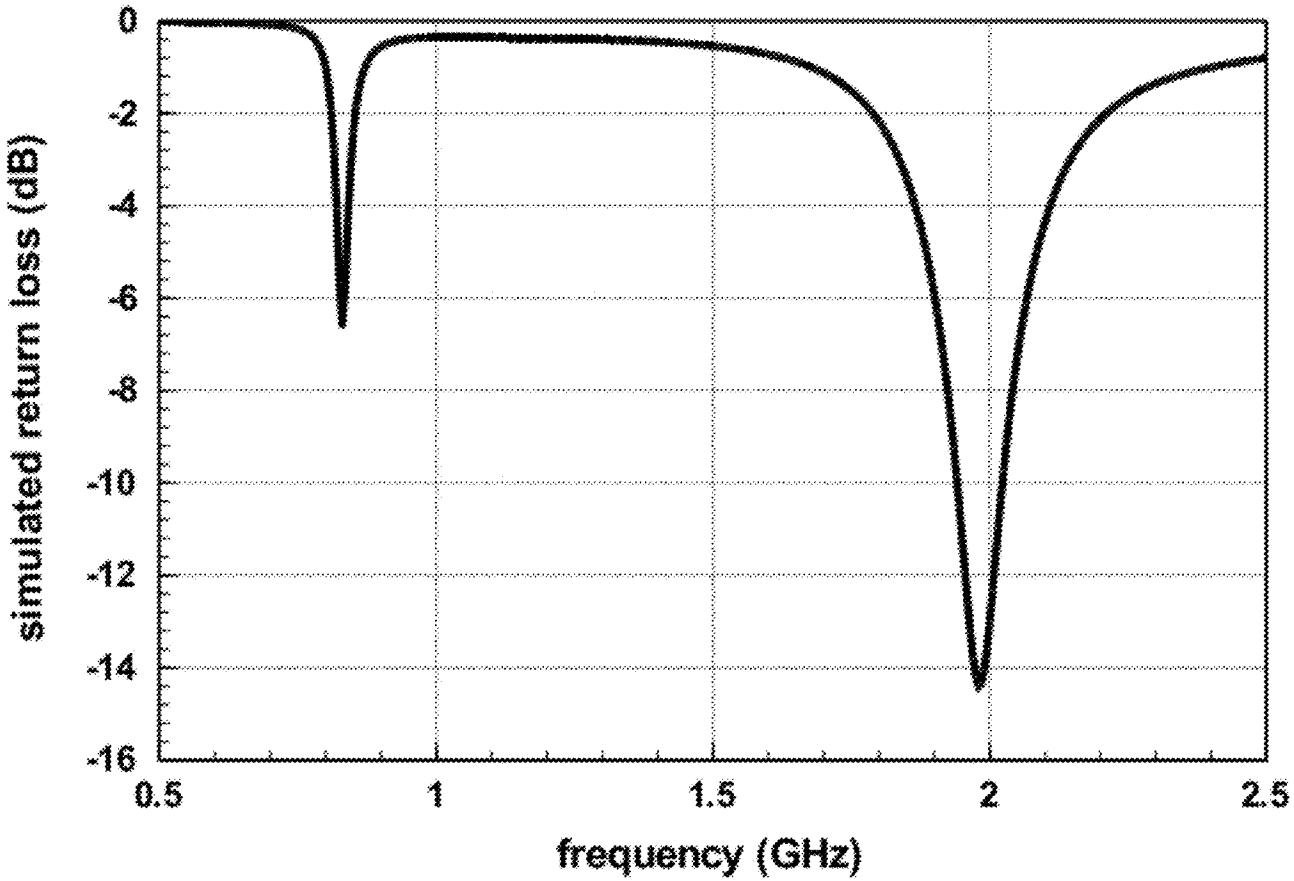
FIG. 14 shows the simulated return loss of the MTM loaded PIFA structure shown in FIGS. 13A-13D.

FIG. 14 shows the simulated return loss of the MTM loaded PIFA structure shown in FIGS. 13A-13D. It can be seen from this figure that the MTM loaded PIFA in this example supports two frequency resonances at 0.83 GHz and 1.98 GHz. The low frequency resonance is a LH mode and the high frequency resonance is a monopole RH mode.

In the multi-substrate implementation shown in FIG. 13A-13D, the ground I 1305 and/or the ground II 1306 can be structured to be a full ground that covers the entire surface of the substrate III without leaving an exposed surface portion. The antenna performance under the influence of user interferences (due to the presence of a human head and a hand) can be improved by the shielding effect arising from the full ground.

Specific embodiments are given in the above description. However, it should be noted that a number of variations and modifications of the disclosed embodiments may also be used. For example, the MTM loading element includes a capacitive component (e.g., a lumped component, a gap formed on the substrate or a combination of both) and an inductive component (e.g., a via line) in the present implementations. However, two or more pairs of such capacitive and inductive components may be included in the MTM loading element. In another example, an additional structure such as a meander line may be included as part of the MTM loading element for the purpose of generating an additional resonance and/or tuning the resonant frequencies. Furthermore, the cell patch and the launch pad can have a variety of geometrical shapes such as but not limited to rectangular, polygonal, irregular, circular, oval, or a combination of different shapes. The via line and the coupling gap can also have a variety of geometrical shapes, lengths and widths such as but not limited to rectangular, irregular, spiral, meander or a combination of different shapes.

While this document contains many specifics, these should not be construed as limitations on the scope of an invention or of what may be claimed, but rather as descriptions of features specific to particular embodiments of the invention. Certain features that are described in this document in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or a variation of a subcombination.

Only a few implementations are disclosed. However, variations and enhancements of the disclosed implementations and other implementations may be made based on what is described and illustrated.

What is claimed is:

1. An antenna device comprising:

a substrate;

a ground electrode formed on the substrate;

a feed line formed on the substrate;

a loading element coupling the feed line and the ground electrode; and a shorting stub formed on the substrate and coupling the feed line and the loading element to the ground electrode, wherein the feed line directs an antenna signal to or from the loading element, and wherein the feed line and the loading element are structured to form a composite right and left handed (CRLH) metamaterial structure that supports a plurality of frequency resonances associated with the antenna signal.

2. The antenna device as in claim 1, wherein the loading element comprises:

a first conductive patch formed on the substrate and coupled to the feed line;

a second conductive patch formed on the substrate, separated from the first conductive patch, and capacitively coupled to the first conductive patch through a dielectric medium; and a via line formed on the substrate and coupling the second conductive patch to the ground electrode.

3. The antenna device as in claim 2, wherein the dielectric medium includes a gap formed on the substrate between the first conductive patch and the second conductive patch, a capacitor, or a combination of both.

4. The antenna device as in claim 1, wherein the shorting stub is structured to provide impedance matching.

5. The antenna device as in claim 1, wherein the substrate has a first surface and a second surface opposite to the first surface;

the feed line is formed on the first surface;

the ground electrode is formed on the first surface; and the loading element is formed on the first surface.

6. The antenna device as in claim 5, wherein the loading element comprises:

a first conductive patch formed on the first surface and coupled to the feed line;

a second conductive patch formed on the first surface, separated from the first conductive patch, and capacitively coupled to the first conductive patch through a dielectric medium; and a via line formed on the first surface and coupling the second conductive patch to the ground electrode.

7. The antenna device as in claim 1, wherein the substrate has a first surface and a second surface opposite to the first surface;

the feed line is formed on the first surface; and the ground electrode is formed on the second surface;

the loading element is formed on the first surface and the second surface and in the substrate.

8. The antenna device as in claim 7, wherein the loading element comprises:

a first conductive patch formed on the first surface and coupled to the feed line;

a second conductive patch formed on the first surface, separated from the first conductive patch, and capacitively coupled to the first conductive patch through a dielectric medium;

a via line formed on the second surface and coupled to the ground electrode; and a via formed in the substrate and coupling the second conductive patch on the first surface and the via line on the second surface.

9. An antenna device, comprising:

a first substrate having a first surface;

a second substrate placed in parallel to the first substrate and having a second surface engaged with the first substrate and a third surface opposite to the second surface;

a ground electrode formed on the second surface;

a feed line formed vertical to the first surface and the second surface, having a first end on the first surface and a second end on the second surface; and a loading element having a first portion formed on the first surface and a second portion formed vertical to the first surface and the second surface, the first portion coupled to the first end of the feed line and the second portion coupled to the ground electrode on the second surface, wherein the feed line directs an antenna signal to or from the loading element, and wherein the feed line and the loading element are structured to form a composite right and left handed (CRLH) metamaterial structure that supports a plurality of frequency resonances associated with the antenna signal.

10. The antenna device as in claim 9, further comprising a third substrate inserted between the first substrate and the second substrate, wherein the feed line and the second portion of the loading element are formed through the third substrate.

11. The antenna device as in claim 10, wherein the first substrate and the second substrate have a first dielectric constant and the third substrate has a second dielectric constant.

12. The antenna device as in claim 11, wherein the third substrate comprises air or a styrofoam.

13. The antenna device as in claim 11, wherein the third substrate comprises a dielectric material.

14. The antenna device as in claim 9, wherein the first portion of the loading element comprises:

a first conductive patch coupled to the feed line; and a second conductive patch separated from the first conductive patch, and capacitively coupled to the first conductive patch through a dielectric medium, and wherein the second portion of the loading element comprises:

a via line coupling the second conductive patch to the ground electrode.

15. The antenna device as in claim 14, wherein the first portion of the loading element further comprises a conductive line formed on the first surface and coupling the second conductive patch to the via line.

16. The antenna device as in claim 9, further comprising a shorting stub that couples the loading element to the ground electrode.

17. The antenna device as in claim 9, wherein the shorting stub comprises:

a first stub portion formed on the first surface and coupled to the loading element; and a second stub portion formed vertical to the first surface and the second surface and coupled to the ground electrode on the second surface.

18. The antenna device as in claim 16, wherein the shorting stub is structured to provide impedance matching.

19. The antenna device as in claim 9, wherein the ground electrode is a full ground covering the second surface without leaving an exposed surface portion.

20. The antenna device as in claim 9, further comprising a second ground electrode formed on the third surface.

21. The antenna device as in claim 20, wherein the second electrode is a second full ground covering the third surface without leaving an exposed surface portion.

* * * * *